US010543700B2

(12) United States Patent
Jariabka et al.

(10) Patent No.: US 10,543,700 B2
(45) Date of Patent: Jan. 28, 2020

(54) PRESSURE PLATE CONTROL

(71) Applicant: Hewlett-Packard Development Company, L.P., Houston, TX (US)

(72) Inventors: Keith Jariabka, Portland, OR (US); Kyle Loucks, Vancouver, WA (US); Mark Groenenboom, Sumner, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/064,243

(22) PCT Filed: Apr. 18, 2016

(86) PCT No.: PCT/US2016/028061
§ 371 (c)(1),
(2) Date: Jun. 20, 2018

(87) PCT Pub. No.: WO2017/184105
PCT Pub. Date: Oct. 26, 2017

(65) Prior Publication Data

US 2018/0370260 A1 Dec. 27, 2018

(51) Int. Cl.
*B65H 3/06* (2006.01)
*B41J 23/12* (2006.01)

(52) U.S. Cl.
CPC ..... *B41J 23/12* (2013.01); *B65H 3/0607* (2013.01); *B65H 3/0669* (2013.01); *B65H 2402/542* (2013.01); *B65H 2403/421* (2013.01); *B65H 2403/512* (2013.01); *B65H 2403/53* (2013.01)

(58) Field of Classification Search
CPC ..... B41J 41/12; B41J 23/12; B65H 3/0607; B65H 3/0661; B65H 2403/51; B65H 2403/512; B65H 2403/514
See application file for complete search history.

(56) References Cited

U.S. PATENT DOCUMENTS

| | | | | |
|---|---|---|---|---|
| 4,859,099 | A | 8/1989 | Kanemoto et al. | |
| 5,011,313 | A | 4/1991 | Sato | |
| 5,152,622 | A | 10/1992 | Rasmussen et al. | |
| 5,800,083 | A | 9/1998 | Gaarder et al. | |
| 6,280,015 | B1 | 8/2001 | Nguyen et al. | |
| 6,337,751 | B1 * | 1/2002 | Kimizuka ..... | H04N 1/00567 271/160 |
| 6,547,236 | B1 | 4/2003 | Yip et al. | |

(Continued)

FOREIGN PATENT DOCUMENTS

| | | |
|---|---|---|
| EP | 1256456 | 11/2005 |
| JP | 11301864 | 11/1999 |

*Primary Examiner* — Howard J Sanders
(74) *Attorney, Agent, or Firm* — HP Inc. Patent Department

(57) ABSTRACT

An example system includes a pressure plate actuating portion. The pressure plate actuating portion includes a cam gear coupled to a cam arm and a pressure plate arranged to be driven by the cam arm as the cam arm rotates with the cam gear through a pick-up cycle, the pressure plate being biased in a first direction toward the cam arm with a pressure plate spring. The example system also includes a pressure plate release control portion, the pressure plate release control portion being arranged to transfer potential energy from the pressure plate spring in a gradual manner.

15 Claims, 5 Drawing Sheets

(56) References Cited

U.S. PATENT DOCUMENTS

| | | | | |
|---|---|---|---|---|
| 6,634,818 | B2 | 10/2003 | Sato et al. | |
| 6,896,253 | B2 * | 5/2005 | Hanabusa | B41J 13/103 271/117 |
| 7,270,323 | B2 * | 9/2007 | Somemiya | B65H 3/0669 271/114 |
| 8,764,158 | B2 | 7/2014 | Asai et al. | |
| 2013/0259553 | A1 * | 10/2013 | Sugiyama | G03G 15/6529 399/381 |
| 2016/0272441 | A1 * | 9/2016 | Okamoto | B65H 1/12 |

* cited by examiner

PRESSURE PLATE CONTROL

BACKGROUND

Printing devices generally print on single sheets of paper that may be stacked in a tray. The printer may cycle through a pick-up cycle during which a pick-up mechanism picks one sheet from the stack of sheets for processing through the printer.

BRIEF DESCRIPTION OF THE DRAWINGS

For a more complete understanding of various examples, reference is now made to the following description taken in connection with the accompanying drawings in which.

DETAILED DESCRIPTION

Various examples described herein provide for a printer pick-up mechanism which includes a pressure plate actuating portion to facilitate picking up a sheet from a stack and a pressure plate release control portion to controllably release the pressure plate. Such controllable release can prevent the pressure plate from forcefully striking other components when the pick-up mechanism releases the pressure plate during the pick-up cycle. In turn, noise level may be reduced or dampened, for example.

Figure 1:
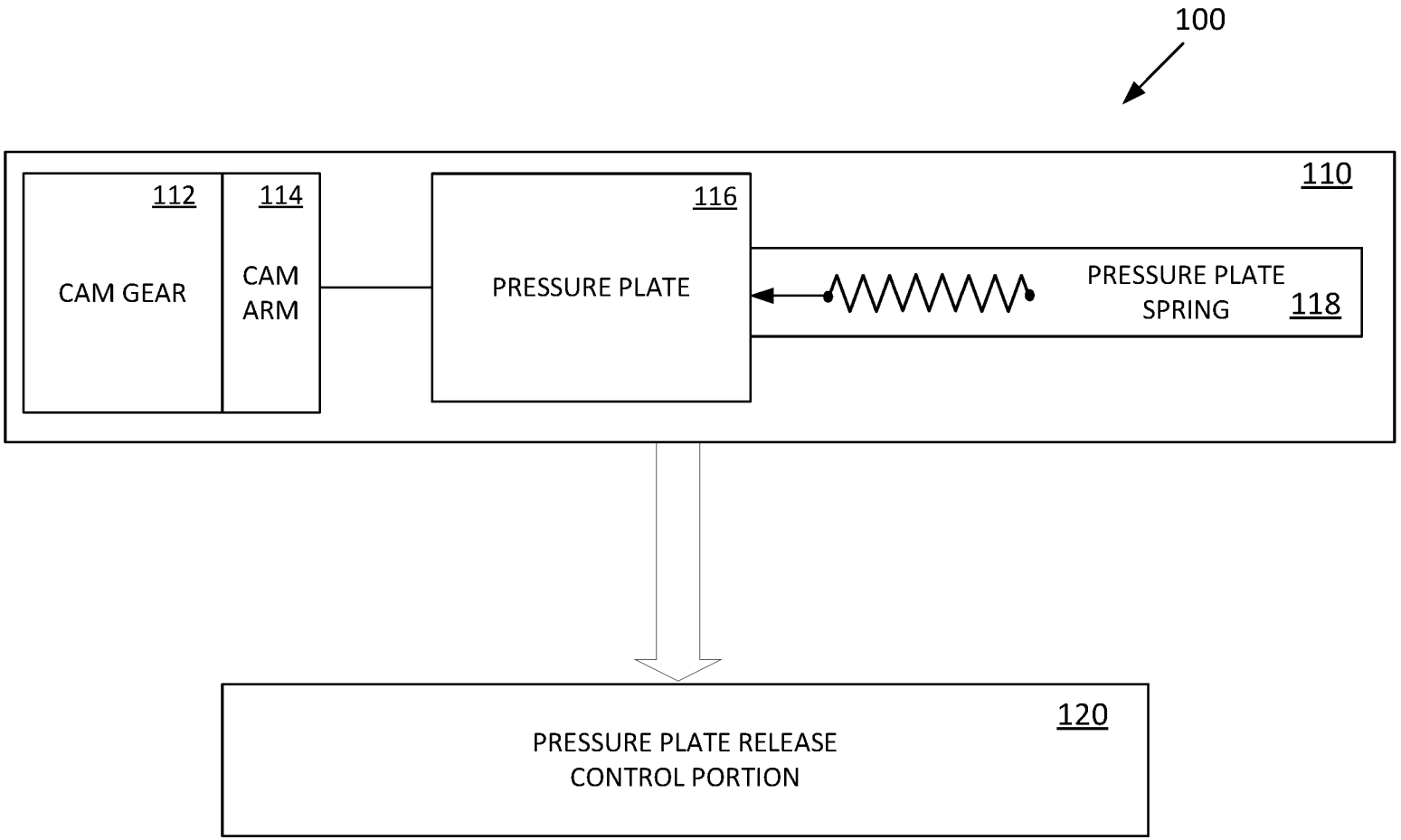
FIG. 1 illustrates a block diagram of an example pressure plate control system.

Referring now to the figures, FIG. 1 illustrates a block diagram of an example pressure plate control system. In the illustrated example system 100, a pressure plate actuating portion 110 is provided to control movement of a pressure plate which may be used in a pick-up mechanism of a printer, for example. As described in greater detail below with reference to FIGS. 3-9, a pick-up mechanism may use a pressure plate actuating mechanism to pick a media from, for example, a stack of media for processing by the printer. The example pressure plate actuating portion 110 illustrated in FIG. 1 includes a cam gear 112 which may be driven by a transmission and/or motor of the printer. The cam gear 112 of the example pressure plate actuating portion 110 is coupled to a cam arm 114 which may rotate with the cam gear 112, as described in the various examples described below with reference to FIGS. 3-9.

The cam arm 114 is arranged to drive a pressure plate 116 as the cam arm 114 rotates with the cam gear 112 through a pick-up cycle. In one example, during the pick-up cycle, the pressure plate 116 is driven through a retracted position and a deployed position. The pressure plate 116 being is toward the cam arm 114 with a pressure plate spring 116. As described below, the pressure plate spring 116 may be secured to a chassis of the printer, for example.

In addition to the pressure plate actuating portion 110, the example pressure plate control system 100 includes a pressure plate release control portion 120. In various examples, as described below, the pressure plate release control portion 120 is arranged to transfer potential energy from the pressure plate or the pressure plate spring in a gradual manner.

Figure 2:
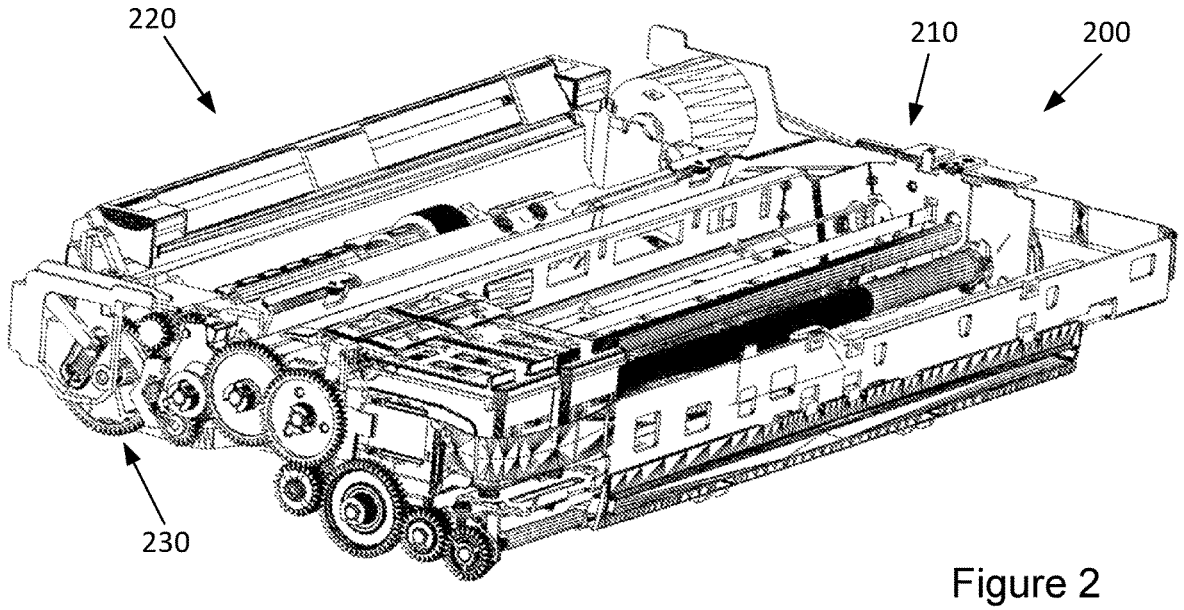
FIG. 2 illustrates a perspective view of an example printer.

FIG. 2 illustrates an example printer in which example pick-up mechanisms may be implemented. In the example illustrated in FIG. 2, the example printer 200 includes a printing section 210 through which media, such as a sheet of paper, may be processed. In this regard, the printing section 210 may include various components such as a printing mechanism by which ink may be deposited onto the media, for example. Various other components may be included but may be omitted from FIG. 2 for purposes of clarity.

The example printer 200 of FIG. 2 further includes a media input section 220. The media input section 220 receives the media (not shown in FIG. 2) and provides it to the printing section 210 for processing. In various examples, the media input section 220 includes a media pick-up mechanism 230, an example of which is illustrated in greater detail in FIG. 3.

Figure 3:
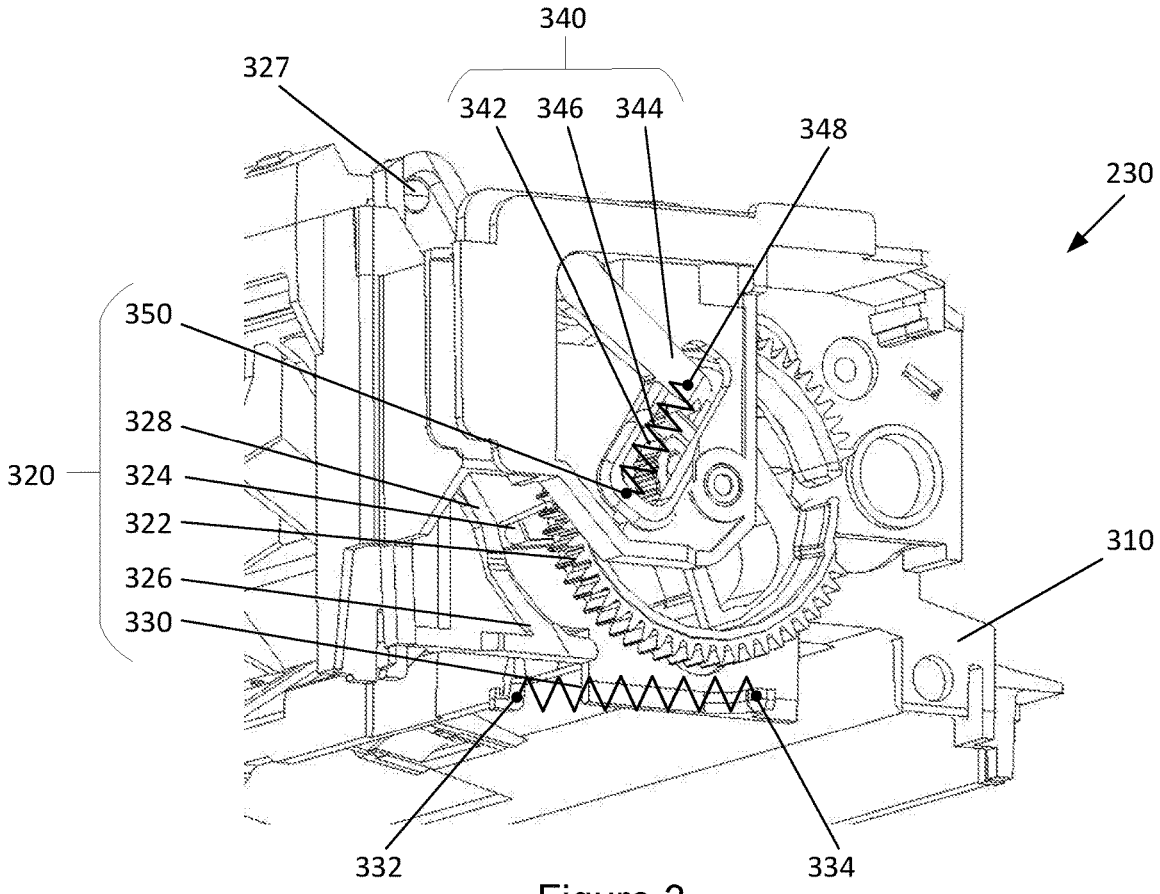
FIG. 3 illustrates a perspective view of an example pick-up mechanism.

Referring now to FIG. 3, the example media pick-up section 230 will now be described. The example media pick-up mechanism 230 is formed on a chassis 310 which may be integrally formed with the body of the printer 200. As illustrated in FIG. 3, the example media pick-up mechanism 230 includes a pressure plate actuating portion 320. In various examples, the media pick-up mechanism 230 picks up media, such as sheets of paper, from a stack by actuating a pressure plate (e.g., pressure plate 326 described below) which drives the media into contact with a rotating pick tire (not shown in FIG. 3). The pressure plate 326 may pivot with respect to the chassis 310 about a pivot point 327. Friction between the rotating pick tire and the media may cause the media to be moved into the media input section 220 and then into the printing section 210.

In the example of FIG. 3, the pressure plate actuating portion 320 includes a cam gear 322 which may be driven by a geared transmission of the printer 200. During a pick-up cycle, the cam gear 322 of the example pressure plate actuating portion 320 rotates clockwise. The cam gear 322 rotates about an axle that is fixed relative to the chassis 310. The cam gear 322 is coupled to a cam arm 324 which rotates with the cam gear in a clockwise direction during a pick-up cycle.

The pressure plate actuating portion 320 of the example media pick-up mechanism 230 includes the pressure plate 326 which has a pressure plate drive surface 328. As illustrated in the example of FIG. 3, the pressure plate 326 is biased with a pressure plate spring 330 toward the cam gear 322. In this regard, during at least part of the pick-up cycle, as illustrated in FIG. 3, the pressure plate spring 330 biases the pressure plate 326 such that the pressure plate drive surface 328 is biased against the cam arm 324.

In the example of FIG. 3, the pressure plate spring 330 is secured to the pressure plate 326 on one end at a pressure plate spring mount 332 and to the chassis 310 on the other end at a chassis mount 334 for the pressure plate spring 330. In various examples, the pressure plate spring 330 may be secured in any of a variety of manners. For example, the pressure plate spring mount 332 and the chassis mount 334 may be loops through which an end of the spring may be hooked.

In various examples, the media pick-up mechanism 230 may include a pressure plate release control portion 340 to provide a counter balance to the spring-biased pressure plate actuating portion 320 described above. The example pressure plate release control portion 340 of the example pick-up mechanism 230 of FIG. 3 includes a cam lobe 342 which rotates with the cam gear 322 of the pressure plate actuating portion 320. In one example, the cam lobe 342 is integrally formed with the cam gear 322. In other examples, the cam lobe 342 may be separately formed and positioned co-axially with the cam gear 322. In this regard, the cam lobe 342 and the cam gear 322 may rotatably fixed to each other.

The example pressure plate release control portion 340 includes a lever arm 344. One end of the lever arm 344 is fixedly mounted to the pressure plate 326 at a fixed end 345 and pivots with the pressure plate 326 as the pressure plate 326 pivots about the pivot point 327. As illustrated in the example of FIG. 3, the other end of the lever arm 344 is a free end which is biased against the cam lobe 342 by a lever spring 346. In the example of FIG. 3, the lever spring 346 is secured to the lever arm 344 on one end at a lever arm spring mount 348 and to the chassis 310 on the other end at a chassis mount 350 for the lever arm spring 346.

In various examples, the lever arm 344 is biased by the lever spring 346 in an opposite direction to the biasing of the pressure plate 326 by the pressure plate spring 330. For example, the pressure plate spring 330 biases the pressure plate 326 to pivot the pressure plate 326 about the pivot point 327 in a counterclockwise direction. By contrast, the lever spring 346 biases the lever arm 344 to pivot the lever arm 344 in a clockwise direction.

Referring now to FIGS. 4-9, side-views of the example pick-up mechanism 230 are illustrated at various stages of an example pick-up cycle. For purposes of clarity, FIGS. 4-9 are illustrated with the chassis removed from the drawings, but the pressure plate spring 330 and the lever arm spring 346 are shown fixed on one end corresponding to the chassis mounts 334, 350 for the corresponding spring 330, 346.

Figure 4:
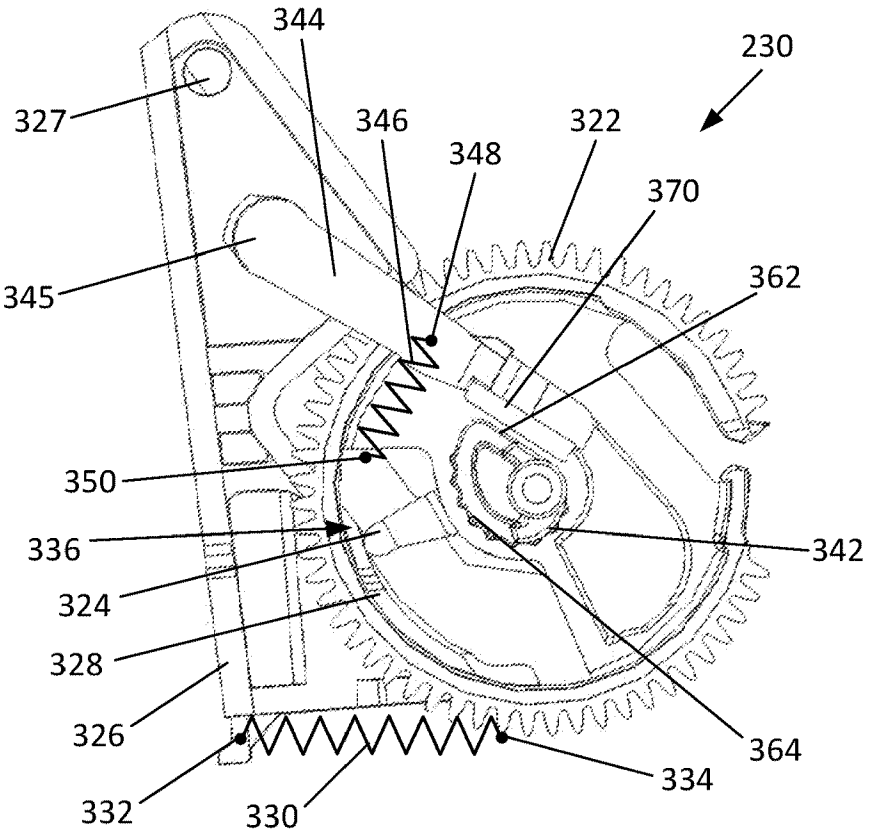

Referring first to FIG. 4, the media pick-up mechanism 230 is illustrated in a position in which the pressure plate 326 is in a retracted position. In this position, the user may load paper into the stack and/or the printer may be in a mode from which a pick-up cycle may begin. In this position, the pressure plate spring 330 is at a substantially maximum extension with the pressure plate drive surface 328 biased against the cam arm 324. Thus, the pressure plate spring 330 is at a point of substantially maximum potential energy. In this position, the cam arm 324 is in contact with the pressure plate drive surface 328 just below an over-center point 336 of the pressure plate drive surface 328.

Further, for the pressure plate release control portion 340, the lever arm 344 is biased against the cam lobe 342 at a flat surface 362 of the cam lobe 342. As illustrated in the example of FIGS. 4-9, the cam lobe 342 is provided with the flat surface 362 which corresponds to the lever spring 346 being in at a substantially minimum extension and, therefore, substantially minimum potential energy. The example cam lobe 342 of FIGS. 4-9 is provided with an elliptical surface 364 on the side opposing the flat surface 362. Of course, in other examples, cam lobes 342 may be provided with a variety of other shapes.

The lever arm 344 includes a lever arm contact surface 370 at its free end. In various examples, the contact surface 370 may be an elastomer pad to provide friction between the lever arm 344 and the cam lobe 342. In other examples, the contact surface 370 may be provided with grooves and/or bumps to provide the friction. The elastomer pad forming the contact surface 370 may also provide acoustic dampening to reduce noise that may be generated from the contact between the lever arm 344 and the cam lobe 342.

Figure 5:
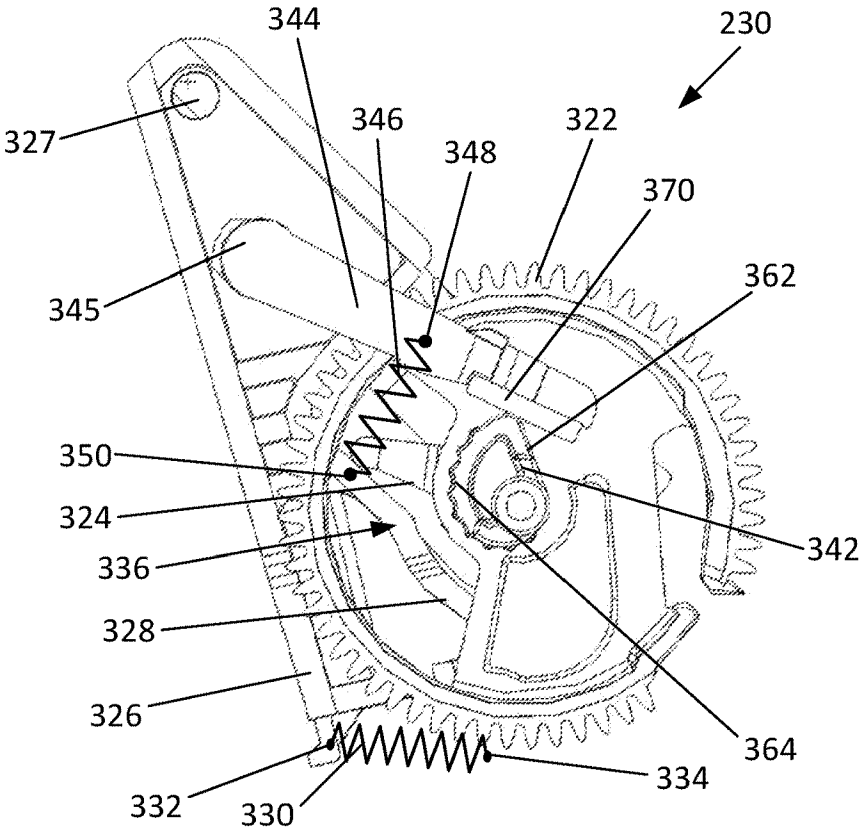
FIGS. 4-9 illustrate side-views of the example pick-up mechanism at various stages of a pick-up cycle.

Referring now to FIG. 5, the media pick-up mechanism 230 is illustrated in a position in which the cam gear has been driven in the clockwise direction from the position shown in FIG. 4. In this position, the cam arm 324 is in contact with the pressure plate drive surface 328 at a point above the over-center point 336. Thus, the pressure plate 326, being biased toward the cam gear 322 by the pressure plate spring 330, may have a tendency to overdrive the cam gear 322 with a release of the potential energy from the pressure plate spring 330.

At the point in the pick-up cycle illustrated in FIG. 5, the pressure plate release control portion 340 may serve to prevent the above-described overdriving of the cam gear 322. As the cam gear 322 rotates clockwise, the movement of the cam arm 324 along the pressure plate drive surface 328 allows the pressure plate 326 to pivot counterclockwise about the pivot point 327. This counterclockwise pivoting of the pressure plate 326 is driven by the release of potential energy by the pressure plate spring 330. At the same time, the lever spring 346 limits the pivoting of the pressure plate 326 since the lever spring 346 must absorb the potential energy released by the pressure plate spring 330. Thus, the lever arm 344 is driven upward by the cam lobe 342 and against the bias of the lever spring, thus transferring potential energy from the pressure plate spring 330 to the lever spring 346.

At the same time, the shape of the cam lobe 342 allows a limited amount of pivoting of the pressure plate 326. In the illustrated example of FIGS. 4-9, the passing of the over-center point 336 by the cam arm 324 approximately coincides with movement of the lever arm 344 of the pressure plate release control portion 340 from the cam lobe flat surface 362 to the cam lobe elliptical surface 364, thus extending the lever spring to a greater extension than the substantially minimum extension illustrated in FIG. 4. Thus, the cam lobe 342 drives the lever arm contact surface 370 upward, causing the pressure plate 326 to pivot counterclockwise. As noted above, the biasing of the lever spring 346 against the cam lobe 342 prevents the pressure plate drive surface 328 from overdriving the cam gear 322. Thus, in progressing from the position illustrated in FIG. 4 to the position illustrated in FIG. 5, potential energy stored in the pressure plate 326 and the pressure plate spring 330 is released and absorbed by the lever arm spring 346.

Figure 6:
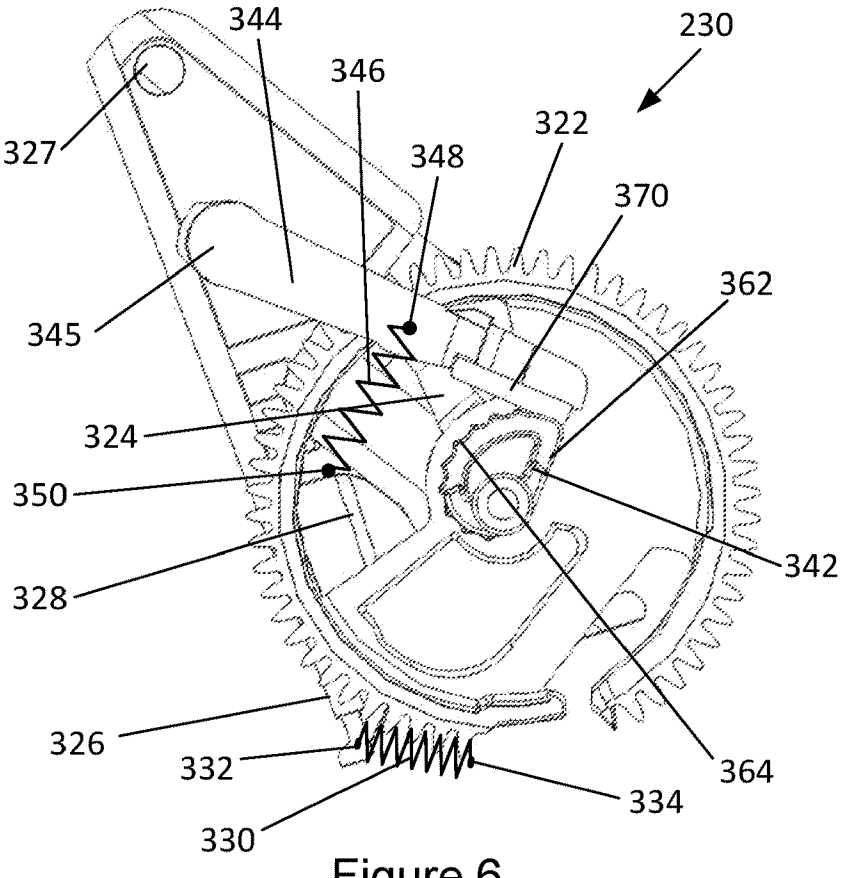

Referring now to FIG. 6, the media pick-up mechanism 230 is illustrated in a position in which the cam gear 322 has been driven further in the clockwise direction from the position shown in FIG. 5. In this position, the cam arm 324 may still be in contact with the pressure plate drive surface 328, and the pressure plate 326 may be substantially at its fully deployed position. For example, as described above, the pressure plate 326 may be in a position in which a rotating pick tire coupled to the pressure plate 326 is driven into contact with media to be picked up and directed into the printing section 210 for processing.

At the point in the pick-up cycle illustrated in FIG. 6, the pressure plate spring 330 is substantially at its minimum extension, and the lever spring 346 is substantially at its maximum extension. In this regard, the extension of the lever spring 346 is driven by the position of the lever arm 344, which is driven to its most upward position by the shape of the cam lobe 342. In the example of FIG. 6, the lever arm contact surface 370 is in contact with an extended part of the cam lobe elliptical surface 364. Thus, at the point in the pick-up cycle illustrated in FIG. 6, the pressure plate spring 330 has transferred most or all of its potential energy to the lever spring 346.

Figure 7:
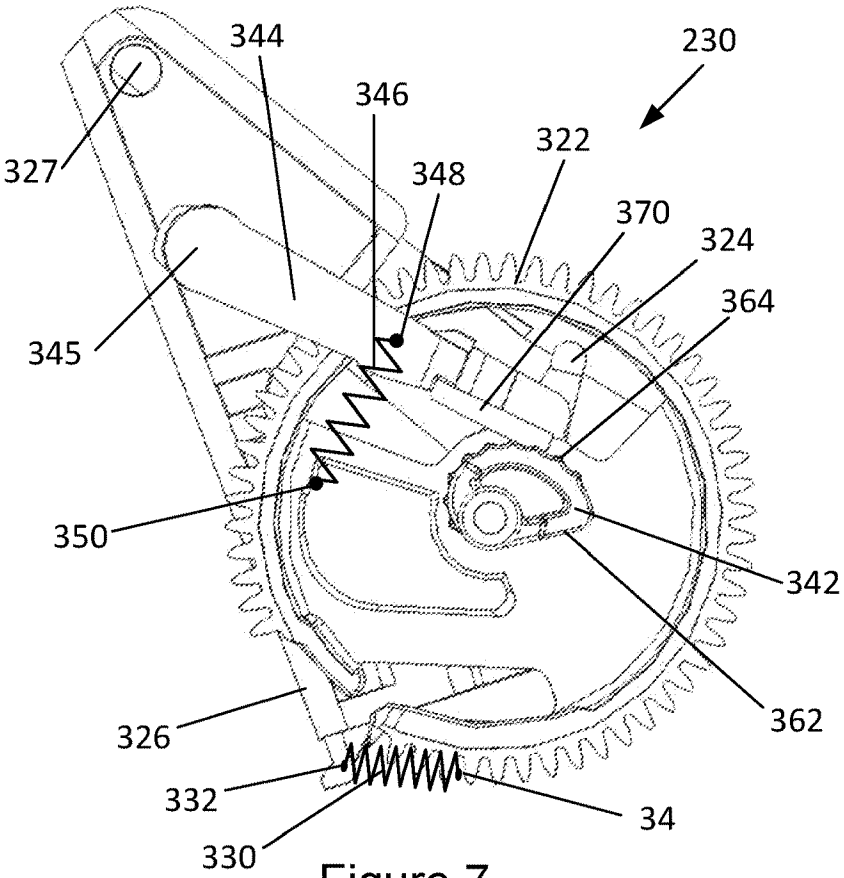

Referring now to FIG. 7, the media pick-up mechanism 230 is illustrated in a position in which the cam gear 322 has been driven further in the clockwise direction from the position shown in FIG. 6. In this position, the cam arm 324 has disengaged from the pressure plate drive surface 328. Thus, the pressure plate 326 is no longer biased against the cam arm 324, and the cam arm 324 does not contribute to any extension of the pressure plate spring 330.

Starting at the position illustrated in FIG. 7, the cam gear 322 and the cam lobe 342 are rotated clockwise such that the cam lobe 342 remains in contact with the lever arm contact surface 370 through the elliptical surface 364 of the cam lobe 342. With the contact surface 370 of the lever arm 344 in contact with the elliptical surface 364, the lever arm 344 is gradually pivoted clockwise. Thus, through the portion of the cycle starting with the position illustrated in FIG. 7, the lever art 344 is returned to its retracted position (e.g., the position illustrated in FIG. 4), and potential energy is substantially completely dissipated from the lever spring 346.

As illustrated in the example of FIGS. 4-9, the elliptical surface 364 of the cam lobe 342 is provided with frictional features, such as ridges, to provide friction between the cam lobe 342 and the lever arm contact surface 370. In this regard, the frictional features may prevent slippage or over-driving of cam lobe 342. In other examples, similar frictional features may be provided on the lever arm contact surface 370 in addition to or in place of the frictional features on the cam lobe 342.

Figure 8:
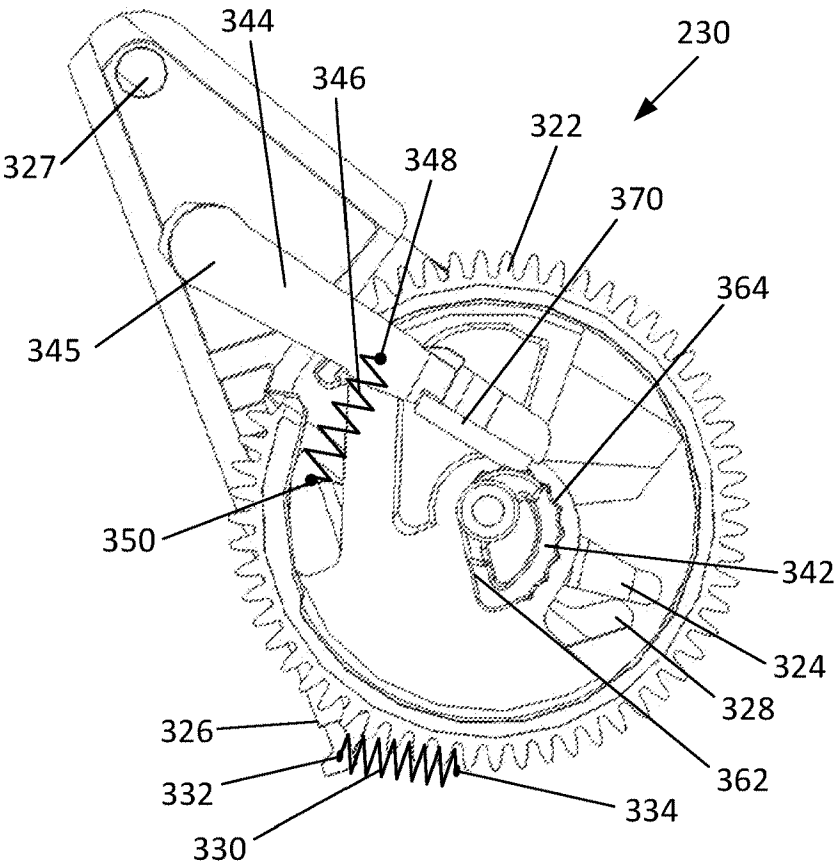

Referring now to FIG. 8, the media pick-up mechanism 230 is illustrated in a position in which the cam gear 322 has been driven further in the clockwise direction from the position shown in FIG. 7. In this position, the cam arm 324 has re-engaged the pressure plate drive surface 328, and the cam lobe 342 has rotated to a position in which the lever arm contact surface 370 is in contact with the short end of the elliptical surface 364 of the cam lobe 342. Thus, compared to the position of FIG. 7, the lever arm 344 in FIG. 8 has further pivoted in a clockwise direction.

Figure 9:
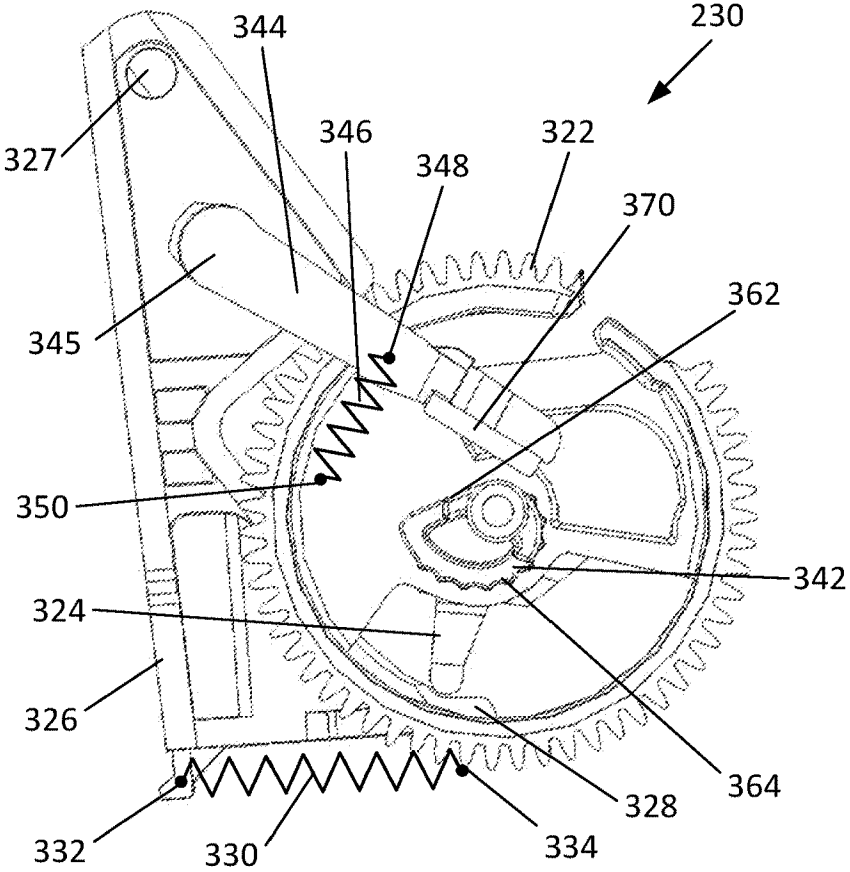

As the cam gear 322 continues to rotate in the clockwise direction, the media pick-up mechanism 230 moves to the position illustrated in FIG. 9. In this position, the cam arm 324 is in full contact with the pressure plate drive surface 328, which is biased against the cam arm 324 by the pressure plate spring 330. Thus, in transitioning from the position illustrated in FIG. 8 to the position illustrated in FIG. 9, the pressure plate 326 may be controllable returned to the initial position in which the pressure plate spring 330 is at its substantially maximum extension. Thus, in the position illustrated in FIG. 9, all or nearly all of the potential energy from the lever spring 346 is substantially dissipated. In various examples, at least some of the energy is dissipated as friction or heat. In other examples, the dissipated energy may be used for a variety of other purposes. For example, the dissipated energy may be used to facilitate retracting the pressure plate 326 back to the position illustrated in FIG. 4, thereby conserving energy required to operate the pick-up mechanism 230.

Thus, in accordance with various examples described herein, a printer pick-up mechanism is provided with an improved controlled operation and movement of the pressure plate. This can provide for a reduced acoustic footprint in the operation of a printer, for example.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system, comprising:

a pressure plate actuating portion, comprising:

a cam gear coupled to a cam arm; and a pressure plate arranged to be driven by the cam arm as the cam arm rotates with the cam gear through a pick-up cycle, the pressure plate being biased in a first direction toward the cam arm with a pressure plate spring; and a pressure plate release control portion, the pressure plate release control portion being arranged to transfer potential energy from the pressure plate or the pressure plate spring in a gradual manner.

2. The system of claim 1, wherein the pressure plate release control portion comprises:

a cam lobe, the cam lobe and the cam gear being arranged to rotate together and co-axially; and a lever arm coupled to the pressure plate, the lever arm arranged to be driven by the cam lobe, the lever arm being biased in a second direction toward the cam lobe with a lever spring, the second direction being opposite the first direction.

3. The system of claim 2, wherein the cam lobe includes a substantially elliptical surface to drive the lever arm to dissipate potential energy from the lever spring.

4. The system of claim 3, wherein the elliptical surface drives the lever arm during a part of the pick-up cycle corresponding to returning of the pressure plate from a deployed position to a retracted position.

5. The system of claim 3, w herein the elliptical surface includes frictional features.

6. The system of claim 2, wherein, the lever arm includes a contact surface biased against the cam lobe by the lever spring.

7. The system of claim 6, wherein the contact surface includes at least of an elastomer, a rubber material or frictional features.

8. A system, comprising:

a cam gear coupled to a cam arm, the cam being rotatable through a pick-up cycle;

a pressure plate arranged to be driven by the cam arm, the pressure plate being spring biased by a pressure plate spring to pivot in a first direction;

a cam lobe, the cam lobe and the cam gear being arranged to rotate together and co-axially; and a lever arm coupled to the pressure plate, the lever arm arranged to be driven by the cam lobe, the lever arm being spring biased by a lever spring to pivot in a second direction, the second direction being opposite the first direction, wherein the cam lobe drives the lever arm and the lever arm spring to absorb potential energy from the pressure plate or the pressure plate spring during at least a part of the pick-up cycle.

9. The system of claim 8, wherein the cam lobe includes a substantially elliptical surface to drive the lever arm to dissipate potential energy from the lever spring in a gradual manner.

10. The system of claim 9, wherein the elliptical surface drives the lever arm during a part of the pick-up cycle corresponding to returning of the pressure plate from a deployed position to a retracted position.

11. The system of claim 9, w herein the elliptical surface includes frictional features.

12. The system of claim 8, wherein the lever arm includes a contact surface biased against the cam lobe by the lever spring.

13. The system of claim 12, wherein the contact ac includes at least one of an elastomer, a rubber material or frictional features.

14. A printer, comprising:

a printing section to print on a media processed therethrough;

a media input section to provide the media to the printing portion, the media input section comprising a media pick-up mechanism to pick up the media, the pick-up mechanism comprising:

a pressure plate actuating portion, comprising:

a cam gear coupled to a cam arm; and a pressure plate arranged to be driven by the cam arm as the cam arm rotates with the cam gear through a pick-up cycle, the pressure plate being biased in a first direction toward the cam arm with a pressure plate spring; and a pressure plate release control portion, the pressure plate release control portion being arranged to transfer potential energy from the pressure plate or the pressure plate spring in a gradual manner.

15. The printer of claim 14, wherein the pressure plate release control portion comprises:

a cam lobe, the cam lobe and the cam gear being arranged to rotate together and co-axially; and a lever arm coupled to the pressure plate, the lever arm arranged to be driven by the cam lobe, the lever arm being biased in a second direction toward the cam lobe with a lever spring, the second direction being opposite the first direction.

* * * * *